United States Patent [19]

Eads et al.

[11] Patent Number: 4,860,727

[45] Date of Patent: Aug. 29, 1989

[54] MOBILE RAIL HEATER AND METHOD FOR EXPANDING RAILS

[76] Inventors: Mark E. Eads; George W. Eads, both of 1020 NW. Blvd., Neosho, Mo. 64850

[21] Appl. No.: 207,240

[22] Filed: Jun. 16, 1988

[51] Int. Cl.[4] ..... F23C 5/00

[52] U.S. Cl. ..... 126/271.2 A; 110/240; 126/271.28; 432/224

[58] Field of Search ..... 432/224, 225; 110/241, 110/240; 126/271.3, 271.1, 271.2 R, 271.2 A, 271.2 B

[56] References Cited

U.S. PATENT DOCUMENTS

| | | | |
|---|---|---|---|
| 896,774 | 8/1908 | Totman | 126/271.2 A |
| 1,238,861 | 9/1917 | Williams et al. | 126/271.2 B |
| 1,419,686 | 6/1922 | Nicholson | 126/271.1 |
| 1,930,309 | 10/1933 | Gallagher | 126/271.2 A |
| 2,427,452 | 9/1947 | Franck | 126/271.2 R |
| 2,815,747 | 12/1957 | Greenfield | 126/271.2 B |
| 2,891,536 | 6/1959 | Ford | 126/271.2 A |
| 3,204,094 | 8/1965 | Huisinga | 126/271.2 B |
| 3,525,326 | 8/1970 | Deal | 126/271.2 A |
| 3,698,380 | 10/1972 | Cook | 126/271.2 A |
| 4,018,540 | 4/1977 | Jackson, Sr. | 126/271.2 A |

*Primary Examiner*—Henry C. Yuen

*Attorney, Agent, or Firm*—Hovey, Williams, Timmons & Collins

[57] ABSTRACT

A method and apparatus for heating railroad rails enabling a convenient and efficient expansion of railroad rails is provided by selectively moving a heat source along a rail. The apparatus includes a frame carrying a heat source such as a series of gas fired burners which direct heat toward the rail to raise the temperature of the rail. The rail heater is provided with a set of wheels enabling the heater to be rolled along a rail while heating the rail. The wheels are mounted to subframes which are shiftably mounted to the frame to permit the heater to conform to the gauge of the rail on which it travels.

11 Claims, 2 Drawing Sheets

FIG. 3.
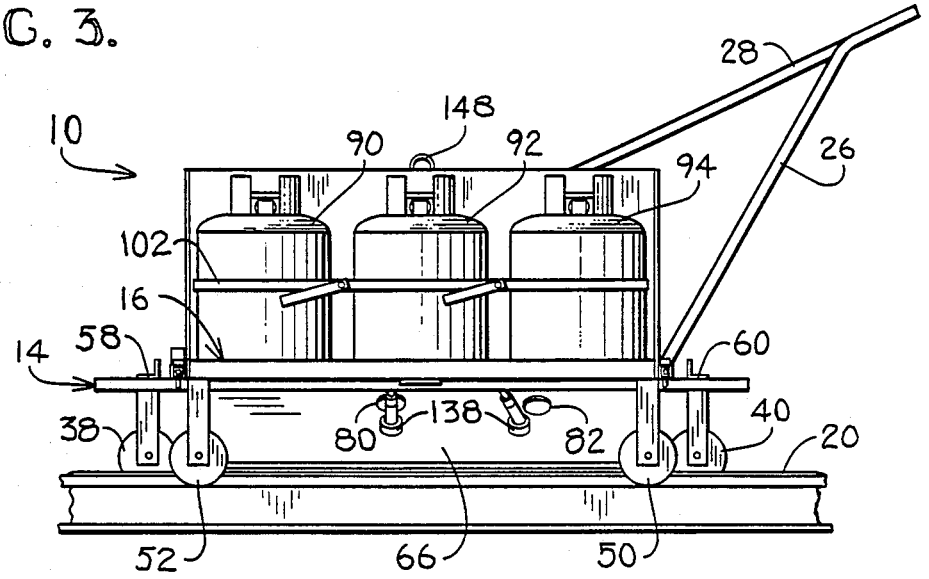
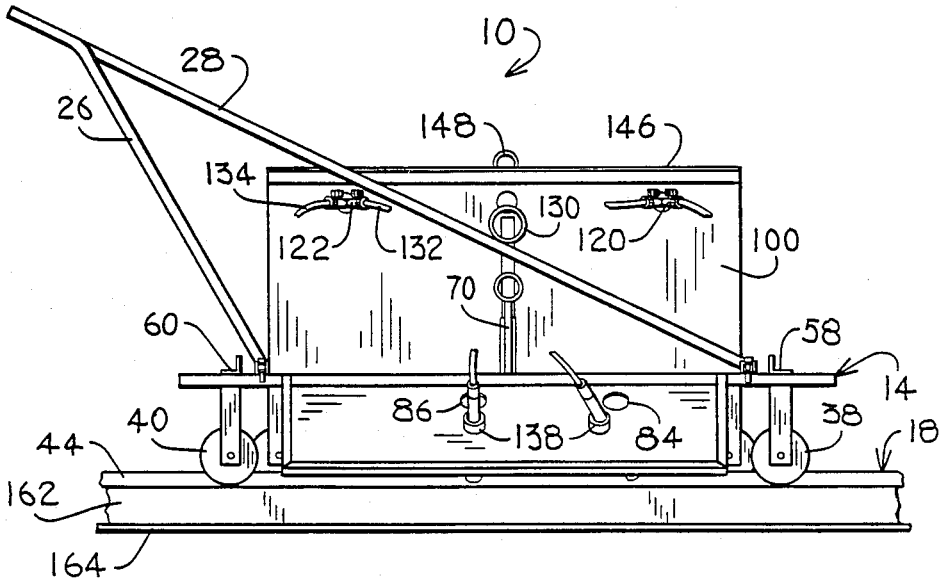
FIG. 4.

MOBILE RAIL HEATER AND METHOD FOR EXPANDING RAILS

BACKGROUND OF THE INVENTION

1. Field of the Invention

A mobile heater for railroad rails of simple yet highly effective construction giving high efficiency, portability and adaptability for use on railroad tracks of different or varying gauges. Also, it is concerned with a method for heating and expanding rails with a mobile rail heater mounted on wheels and having a series of gas burners mounted under a heat shield and connected to compressed gas bottles. The mobile rail heater is adapted to roll along a pair of railroad rails and to heat one of the rails on which it is carried.

2. Description of the Prior Art

Railroad rails laid on timbers are well known to everyone as the roads on which railway trains have travelled through this country for over a century. Some of the rails, varying from 30 feet to one-fourth mile in length, have been subject to stress and fatigue through usage, for years. In the past, the rails were welded together at their joints, while present practice is to use large bolts and plates to connect the rails at the joints. When the rails are at ambient temperature it is desirable that each rail be somewhat in tension along its length.

When a rail fails from stress or fatigue or a joint must be repaired or replaced, the length of the rail must be increased from ¼"to 4" depending on the difference between the rail length and the distance between the adjacent rails. While the rail might conceivably be drawn manually by clamps or the like, it is impractical to do so because of the great tensile strength of the iron rail.

It has been the practice to heat the rail to cause it to expand. The heating of the rail has heretofore been accomplished by soaking ropes in a fifty-five gallon drum of diesel fuel, with a rope then being laid on each side of the web of a rail and then ignited. The ropes usually burn for up to three hours, following which the process must be repeated in the event the rail has not sufficiently expanded. In winter climates, the burning rope will not heat the rail sufficiently to expand it and thus no new rail may be laid during this period.

SUMMARY OF THE INVENTION

The problems outlined above are in large measure solved by the present mobile rail heater. The mobile rail heater effectively heats a length of rail in a matter of minutes, even in extreme cold. A section of the rail may be heated gradually, providing an annealing effect and avoiding thermal stress to the rail as it heats. The mobile rail heater is easily handled by one person and maintains a uniform application of heat along the rail.

The mobile rail heater broadly includes a frame supported by spaced wheels which roll on a pair of spaced apart rails. Mounted on one side of the frame is a heating element subframe including a burner unit which directs heat toward one of the rails. On the opposite side of the frame is a fuel source which is connected to the burner unit by a conduit. The burner unit includes a series of burners, the first and last burner being angled with respect to the rail to provide a preheating and annealing effect. The burner unit may be shielded as an aid in retaining heat in the vicinity of the rail, reducing noise, and blocking the bright light generated by the burners.

In particularly preferred forms, the wheels are connected to the burner unit and to a fuel carrying subframe having a shelf supporting the fuel source, with the wheels having rims spaced apart a standard rail width. The heating element subframe and fuel carrying subframe are adjustably mounted on the frame so as to move in and out with respect to the frame as the gauge of the track varies. The frame may be detached from the heating element subframe and fuel carrying subframe by removing quick release pins in the frame, thus enabling the mobile rail heater to be easily transported. An anchor is attached to the frame which may be released to prevent the mobile rail heater from rolling on a grade. An ignition wand is connected to the fuel source to enable the burner unit to be safely ignited.

It may be appreciated that the mobile rail heater hereof may be used to heat any elongated metal object requiring the application of heat along the length thereof. Thus, various I-beams, construction beams, rods or members may be easily heated in accordance with the present invention, and the term rail as used herein is intended to include all such similar elongated metal object..

BRIEF DESCRIPTION OF THE DRAWINGS

FIG. 3 is a side elevational view of the mobile rail heater; and

FIG. 4 is a side elevational view showing the side opposite to that shown in FIG. 3.

DESCRIPTION OF THE PREFERRED EMBODIMENT

Figure 1:
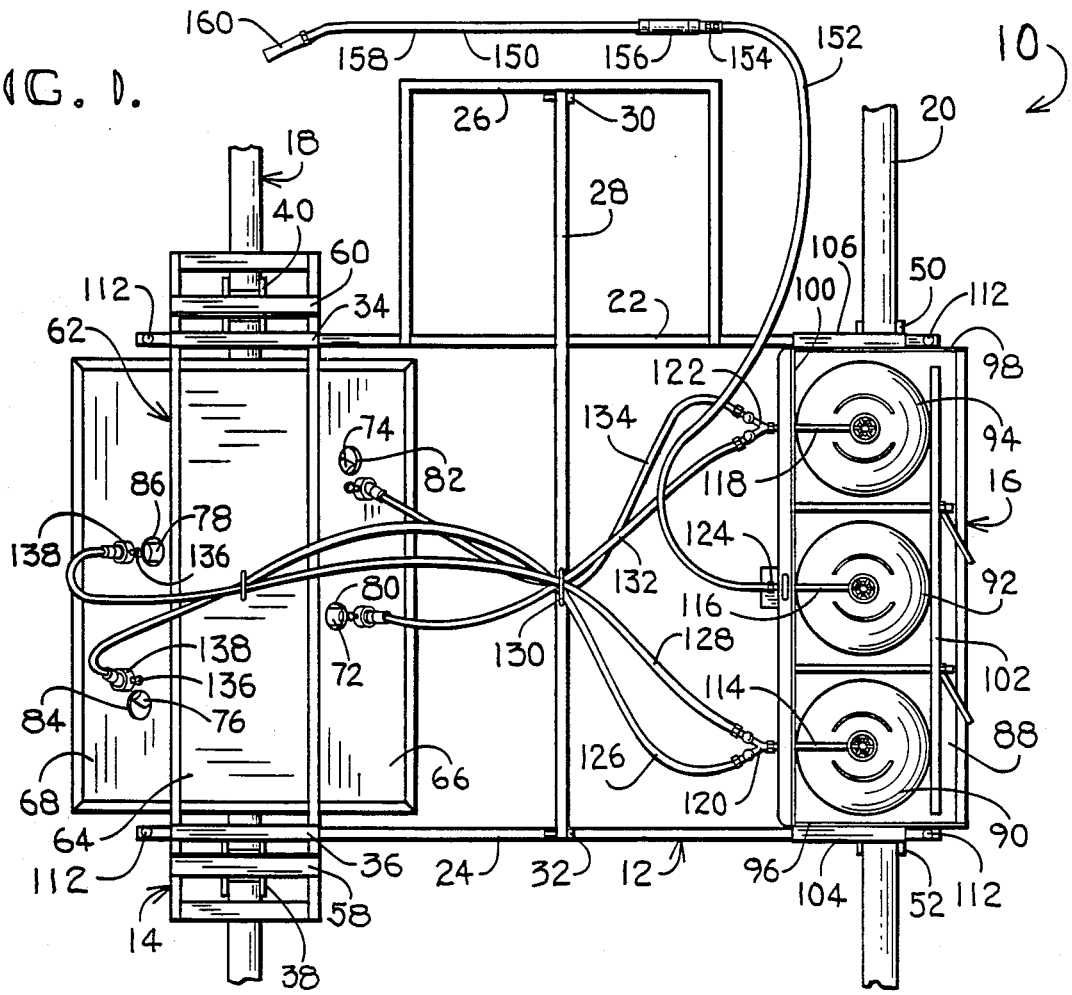
FIG. 1 is a top plan view of the mobile rail heater.

Referring now to the drawing, the mobile rail heater 10 broadly includes a frame 12, a heating element subframe 14 in the form of a wheeled carriage which is shiftably mounted to and carried by the frame 12, and a fuel carrying subframe 16 in the form of a wheeled carriage which is carried by the frame 12 and shiftably mounted thereon. The subframes 14 and 16 are adapted to move laterally with respect to frame 12 to compensate for any variation in the gauge between rails 18 and 20.

Frame 12 includes cross members 22 and 24, U-shaped push bar 26 welded to cross member 22, and a brace 28 removably mounted to the push bar 26 and cross member 24. Quick release pins 30 and 32 are inserted through holes drilled in the brace and through mating, drilled receivers on the push bar 26 and cross member 24. Cross members 22 and 24, U-shaped push bar 26 and brace 28 are constructed of tubular steel adapted to be suitably welded into the shapes and configurations as shown.

Frame 12 is supported on beams or rails 18 and 20 through heating element subframe 14 and fuel carrying subframe 16. Heating element subframe 14 includes sleeves 34 and 36 of a sufficient internal dimension so that portions of cross members 22 and 24 may fit through sleeves 34 and 36 and sleeves 34 and 36 may shift laterally on cross members 22 and 24. Heating element subframe 14 is supported on the rail by a pair of wheels 38 and 40. Each wheel 38 and 40 is constructed of a cylindrical center section 42 adapted to roll on top of the ball 44 of the rail 18. The wheel is further provided with a pair of opposing flanges 46 and 48 mounted on section 42 so as to extend along the outside of the ball 44 of the rail 18. Wheels 40, 50, and 52 are similarly constructed.

Heating element subframe 14 is supported above the wheels by a pair of struts 54 and 56. The struts extend vertically a sufficient distance above the axle of the wheels to insure the proper clearance of the heating element subframe 14 above the rail 18. Struts 54 and 56 are in turn welded to cross brace 58 which forms a portion of the heating element subframe 14. A similar cross brace 60 is located at the opposite end of the heating element subframe 14.

A heat shield 62 is welded to heating element subframe 14 and is in the form of a metal sheet with a substantially horizontal center section 64, an inner section 66 and an outer section 68, sections 66 and 68 being oriented at an oblique angle downward with respect to center section 64. Center section 64 is provided with a post and ring 70.

Venturi burners 72 and 74 are mounted on inner section 66 of heat shield 62, while venturi burners 76 and 78 are mounted on outer section 68 of heat shield 62. The burners 72, 74, 76 and 78 are mounted in staggered relationship along heat shield 62 as shown in FIG. 1, so that the burners are directed toward different portions of the rail. Burners 72 and 78 are oriented so as to be substantially normal to the longitudinal axis of the rail as shown in FIG. 1, while burners 74 and 76 are angled with respect to the rail so as to distribute the heat provided by the burners 74 and 76 to a longer section of the rail and so that the heat provided from burners 74 and 76 is of a lesser intensity once it reaches rail 18 than the heat from burners 72 and 78.

A series of four ventilation ports 80, 82, 84 and 86 are defined by the heat shield 62 and located substantially above each of the burners 72, 74, 76 and 78 so as to vent the fumes created by the combustion of the propane or other gas used to fuel the burners. The burners as used in the invention hereof are conventional 500,000 BTU per hour burners commercially available from Western Enterprises of Westlake, Ohio.

Located over the opposite rail 20 is fuel carrying subframe 16. Subframe 16 is provided with a shelf 88 adapted to carry three, twenty pound propane tanks 90, 92 and 94. End walls 96 and 98 and sidewall 100 together with retaining bar 102 maintain the tanks 90, 92 and 94 in position on top of shelf 88.

Sleeve 104 is mounted adjacent end wall 96 and sleeve 106 is mounted adjacent end wall 98 and are adapted to receive a portion of cross members 22 and 24 therewithin, such that fuel carrying subframe 16 is shiftably mounted on frame 12. Fuel carrying subframe 16 is supported above rail 20 by wheels 50 and 52 and struts 108 and 110, all of which are similar to wheels 38 and 40, and struts 54 and 56. Struts 108 and 110 are welded to shelf 88, as are similar struts mounted over wheel 50. Quick release pins 112 are mounted at the distal ends of frame 12 to prevent subframes 14 and 16 from shifting beyond their normal operating range.

Pipes 114, 116 and 118 extend through sidewall 100 to tanks 90, 92 and 94 respectively. Pipes 114 and 116 are further provided with quickconnect Y couplings 120, 122 while pipe 116 is provided with a single quick-connect coupling 124. Lengths of conduit 126, 128 are routed through ring 130 on brace 28 to connect to burners 76 and 78 respectively. Burners 72 and 74 are connected by conduit 132 and 134 through ring 130 to Y coupling 122. Y coupling 120 and Y coupling 122 are provided with valves to regulate the flow of propane into the conduit 126, 128, 132 and 134. The conduits 126, 128, 132, and 134 are connected to their respective burners by conventional, threaded connections with the burners maintained in position by thumbscrews 136 threaded through guides 138 welded to the heat shield 62.

Sidewall 100 is further provided with an anchor 140 releasably coupled to mount 142 which is welded to sidewall 100. Pin 144 is fitted through the side of mount 142 to engage anchor 140 and prevent it from a vertical descent. Mounted along top rib 146 of sidewall 100 is a winch ring 148 enabling fuel carrying subframe 16 to be lifted and carried separately when removed from frame 12.

An ignition wand 150 is connected by conduit 152 to single quick connect coupling 124 and is adapted to be inserted through ports 80, 82, 84 and 86 for ignition of the burners 72, 74, 76 and 78. Wand 150 is provided with a quick connect coupling 154 adjacent handle 156 and an elongated copper tube 158 terminating in a ported nozzle 160.

In operation, the mobile rail heater may be brought to the site in sections for easy transportation. Thus, frame 12, heating element subframe 14, fuel carrying subframe 16, brace 28, tanks 90, 92 and 94, conduit and wand 150 may all be separately transported to the site for assembly at the site. After placing heating element subframe 14 on rail 18 and fuel carrying subframe 16 on rail 20, frame 12 may be positioned so that cross members 22 and 24 are inserted through channels 34 and 106 and 36 and 104 respectively. Brace 28 may be attached to cross member 24 and push bar 26 by the use of quick release pins 30 and 32 and quick release pins 112 may be mounted through holes located at the distal ends of cross members 22 and 24. Conduits 126 and 128 are routed through ring 130 and post and ring 70 to be connected by, for example, quick disconnect couplings, to burners 76 and 78, while conduit 132 and 134 are routed through ring 130 to be connected by, for example, quick disconnect couplings, to burners 72 and 74. Conduit 152 is connected to wand 150, and pipes 114, 116 and 118 are connected to tanks 90, 92 and 94 which are placed on shelf 88. The unit is then pushed by push-bar 26 to the desired location prior to energization of the burners. Valves located on the top of the propane tanks are then opened and wand 150 is ignited prior to lighting burners 72, 74, 76 and 78.

To begin expanding the rail, nozzle 160 of wand 150 is sequentially inserted through ventilation ports 80, 82, 84 and 86 and gas is permitted to flow through the respective conduits to burners 72, 74, 76 and 78 as the lit nozzle 160 is inserted through the respective ports. The supply of gas to wand 150 is then extinguished and mobile rail heater 10 is moved along rails 18 and 20 so as to heat rail 18 to the desired temperature.

Figure 2:
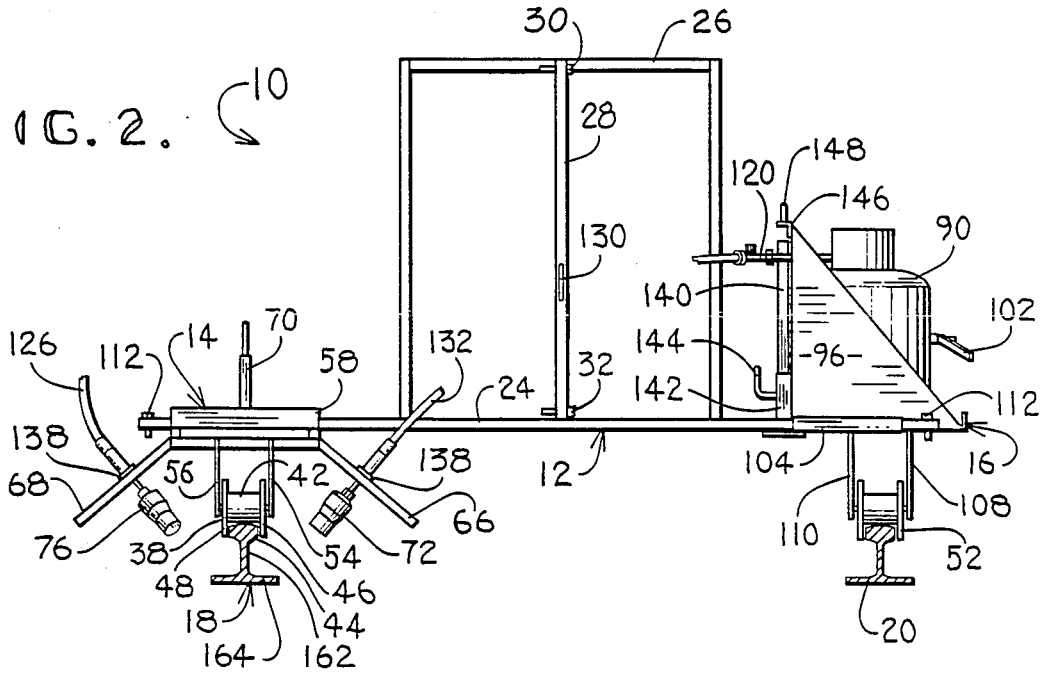
FIG. 2 is a front elevational view of the mobile rail heater with portions of the conduit removed.

As may be seen from FIG. 2, the burners are directed substantially toward the web 162 which constitutes that portion of the rail between the ball 44 and the flange 164 while the rail may be heated to temperatures above 350' F. by this method and apparatus, it is typically the practice to heat the rail to 112 to 116' in order to be able to work satisfactorily on the rail 18 once the rail 18 has reached the desired amount of expansion.

It may be appreciated from the foregoing that when nozzles 76 and 74 are angled with respect to the rail, the temperature of the rail during the heating process is raised and lowered gradually and more of the rail 18 is permitted to expand than if burners 74 and 76 were oriented substantially normal to the rail. It has been found that burners 74 and 76 are preferably angled approximately 30' with respect to the rail in order to provide optimum performance, heat distribution and the desired annealing effect.

It may also be appreciated that the gauge of the rail is somewhat changeable. To adjust to the various distance between rails 18 and 20, the mobile rail heater hereof is adapted to permit heating element subframe 14 and fuel carrying subframe 16 to shift laterally along frame 12 as wheels 38, 40, 50 and 52 follow along the balls 44 of the rails. The ability of the mobile rail heater 10 to adapt to variations in the gauge of the rail is especially advantageous inasmuch as the rails 18 and 20 may be curved or may be damaged causing the gauge to vary. Further, quick release pins 112 prevent the subframes 14 and 16 from varying too greatly and perhaps falling off frame 22.

In the event that the mobile rail heater 10 should be used on a substantial grade where it is difficult to maintain the mobile rail heater 10 in proper position, pin 144 may be removed from mount 142, thus permitting anchor 140 to drop and lodge against a railroad tie in order to prevent the mobile rail heater from rolling. When the anchor is in the down position, the mobile rail heater 10 will not move beyond the next tie.

It may be appreciated that various fuel sources may be used in conjunction with the heater which we have described, and that various means of mechanical propulsion may be substituted for the push bar which we have recited without changing the scope of our invention.

Having thus described the invention, what is claimed as new and desired to be secured by Letters Patent is:

1. A mobile rail heated for use with a pair of spaced rails each having a longitudinal axis comprising:

a pair of spaced apart wheeled carriage assemblies oriented for riding atop one of said spaced rails;

burner means carried by said carriage assemblies and oriented for applying heat to said one rail;

wheeled support means spaced laterally from said assemblies and located for riding atop the other of said rails; and frame means for interconnecting said carriage assemblies in laterally spaced relationship to said support means, including structure for varying the spacing between said carriage assemblies and said support means while maintaining said burner means in said heat-applying orientation relative to said one rail, said frame structure serving to vary said spacing in response to variable distances between said one rail and said other rail encountered during movement of said heater as a unit along said rails.

2. A mobile rail heater as set forth in claim 1, including a structure on said carriage assembly for shiftably receiving said frame.

3. A mobile rail heater as set forth in claim 2, including structure on said wheeled support means for shiftably receiving said frame.

4. A mobile rail heater as set forth in claim 3, including first stop means for limiting relative shifting movement between said frame and said carriage assemblies and second stop means for limiting relative shifting movement between said frame and said support means.

5. A mobile rail heater as set forth in claim 4, wherein said first and second stop means comprise quick-release pins inserted through said frame respectively adjacent said carriage assemblies and said support means.

6. A mobile rail heater as set forth in claim 5, including structure enabling separation of said carriage assembly and said burner means from said frame by removal of said first stop means and lateral shifting of said carriage assemblies and said burner means along said frame.

7. A mobile rail heater as set forth in claim 4, including structure enabling separation of said support means from said frame by removal of said second stop means and lateral shifting of said support means relative to said frame.

8. A mobile rail heater as set forth in claim 1, wherein said burner means includes a burner element oriented for heating a portion of said rail intermediate said carriage assemblies.

9. A mobile rail heater as set forth in claim 8, there being a plurality of said burner elements, each of said burner elements being oriented for heating the portion of said rail intermediate said carriage assemblies.

10. a mobile rail heater as set forth in claim 9, said rail presenting two opposite sides along a web thereof, wherein said burner elements are mounted in longitudinally staggered relationshiop along said first rail with longitudinally successive burner elements oriented toward said opposite sides of said rail.

11. A mobile rail heater as set forth in claim 1, including separate ignition means carried by said heater for selectively igniting said burner means.

* * * * *